US006259048B1

(12) United States Patent
Castonguay et al.

(10) Patent No.: US 6,259,048 B1
(45) **Date of Patent: *Jul. 10, 2001**

(54) ROTARY CONTACT ASSEMBLY FOR HIGH AMPERE-RATED CIRCUIT BREAKERS

(75) Inventors: Roger N. Castonguay, Terryville; Randall L. Greenberg, Granby; Dean A. Robarge, Southington; Dave S. Christensen, Burlington, all of CT (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/258,616

(22) Filed: Feb. 26, 1999

Related U.S. Application Data

(63) Continuation-in-part of application No. 09/087,038, filed on May 29, 1998.

(51) Int. Cl.[7] ..... H01H 1/22

(52) U.S. Cl. ..... 200/244; 200/274; 335/16; 218/22

(58) Field of Search ..... 200/1 R, 6 R, 200/11 R, 17 R, 400, 401, 501, 244, 248, 287, 323–325, 336, 337, 50.01, 50.32–50.35; 218/22, 30–33, 146; 335/16

(56) References Cited

U.S. PATENT DOCUMENTS

| | | | |
|---|---|---|---|
| D. 367,265 | 2/1996 | Yamagata et al. | D13/160 |
| 2,340,682 | 2/1944 | Powell | 200/147 |
| 2,719,203 | 9/1955 | Gelzheiser et al. | 200/144 |
| 2,937,254 | 5/1960 | Ericson | 200/114 |
| 3,158,717 | 11/1964 | Jencks et al. | 200/116 |
| 3,162,739 | 12/1964 | Klein et al. | 200/88 |
| 3,197,582 | 7/1965 | Norden | 200/50 |
| 3,307,002 | 2/1967 | Cooper | 200/116 |
| 3,517,356 | 6/1970 | Hanafusa | 335/16 |
| 3,631,369 | 12/1971 | Menocal | 337/110 |
| 3,803,455 | 4/1974 | Willard | 317/33 SC |
| 3,883,781 | 5/1975 | Cotton | 317/14 R |
| 3,953,811 * | 4/1976 | Mostosi | 335/16 |
| 4,129,762 | 12/1978 | Bruchet | 200/153 G |
| 4,144,513 | 3/1979 | Shaffer et al. | 335/46 |
| 4,158,119 | 6/1979 | Krakik | 200/240 |
| 4,165,453 | 8/1979 | Hennemann | 200/153 G |
| 4,166,988 | 9/1979 | Ciarcia et al. | 335/9 |
| 4,220,934 | 9/1980 | Wafer et al. | 335/16 |
| 4,255,732 | 3/1981 | Wafer et al. | 335/16 |
| 4,259,651 | 3/1981 | Yamat | 335/15 |
| 4,263,492 | 4/1981 | Maier et al. | 200/288 |
| 4,276,527 | 6/1981 | Gerbert-Gaillard et al. | 335/39 |
| 4,297,663 | 10/1981 | Seymour et al. | 335/20 |
| 4,301,342 | 11/1981 | Castoguay et al. | 200/153 SC |
| 4,360,852 | 11/1982 | Gilmore | 361/98 |
| 4,368,444 | 1/1983 | Preuss et al. | 335/166 |
| 4,375,021 | 2/1983 | Pardini et al. | 218/25 |

(List continued on next page.)

FOREIGN PATENT DOCUMENTS

| | | | |
|---|---|---|---|
| 819 008 | 12/1974 | (BE) | H01H/83/14 |
| 897 691 | 9/1982 | (BE) | H01H/71/24 |
| 708972 | 1/1940 | (DE) . | |
| 12 27 978 | 11/1966 | (DE) . | |
| 30 47 360 | 6/1982 | (DE) | H01H/85/20 |

(List continued on next page.)

*Primary Examiner*—Michael Friedhofer
(74) *Attorney, Agent, or Firm*—Cantor Colburn LLP; Carl B. Horton

(57) ABSTRACT

A circuit breaker rotary contact assembly employs a common pivot between the rotor assembly and the rotary contact arm. A pair of off-center expansion springs directly engage the rotor at one end and engage the rotary contact arm via a linkage arrangement at an opposite end thereof.

19 Claims, 8 Drawing Sheets

U.S. PATENT DOCUMENTS

| | | | | |
|---|---|---|---|---|
| 4,375,022 | | 2/1983 | Daussin et al. | 200/148 R |
| 4,376,270 | | 3/1983 | Staffen | 335/21 |
| 4,383,146 | | 5/1983 | Bur | 200/17 R |
| 4,392,036 | | 7/1983 | Troebel et al. | 200/322 |
| 4,393,283 | | 7/1983 | Masuda | 200/51.09 |
| 4,401,872 | | 8/1983 | Boichot-Castagne et al. | 200/153 G |
| 4,409,573 | | 10/1983 | Di Marco et al. | 335/16 |
| 4,435,690 | | 3/1984 | Link et al. | 335/37 |
| 4,467,297 | | 8/1984 | Boichot-Castagne et al. | 335/8 |
| 4,468,645 | | 8/1984 | Gerbert-Gaillard et al. | 335/42 |
| 4,470,027 | | 9/1984 | Link et al. | 335/16 |
| 4,479,143 | | 10/1984 | Watanabe et al. | 358/44 |
| 4,488,133 | | 12/1984 | McClellan et al. | 335/16 |
| 4,492,941 | | 1/1985 | Nagel | 335/13 |
| 4,541,032 | | 9/1985 | Schwab | 361/331 |
| 4,546,224 | | 10/1985 | Mostosi | 200/153 G |
| 4,550,360 | | 10/1985 | Dougherty | 361/93 |
| 4,562,419 | | 12/1985 | Preuss et al. | 335/195 |
| 4,589,052 | | 5/1986 | Dougherty | 361/94 |
| 4,595,812 | | 6/1986 | Tamaru et al. | 200/307 |
| 4,611,187 | | 9/1986 | Banfi | 335/16 |
| 4,612,430 | | 9/1986 | Sloan et al. | 200/327 |
| 4,616,198 | | 10/1986 | Pardini | 335/16 |
| 4,622,444 | | 11/1986 | Kandatsu et al. | 200/303 |
| 4,631,625 | | 12/1986 | Alexander et al. | 361/94 |
| 4,642,431 | | 2/1987 | Tedesco et al. | 200/401 |
| 4,644,438 | | 2/1987 | Puccinelli et al. | 361/75 |
| 4,649,247 | | 3/1987 | Preuss et al. | 200/244 |
| 4,658,322 | | 4/1987 | Rivera | 361/37 |
| 4,672,501 | | 6/1987 | Bilac et al. | 361/96 |
| 4,675,481 | * | 6/1987 | Markowski et al. | 200/144 R |
| 4,682,264 | | 7/1987 | Demeyer | 361/96 |
| 4,689,712 | | 8/1987 | Demeyer | 361/96 |
| 4,694,373 | | 9/1987 | Demeyer | 361/96 |
| 4,710,845 | | 12/1987 | Demeyer | 361/96 |
| 4,717,985 | | 1/1988 | Demeyer | 361/96 |
| 4,733,211 | | 3/1988 | Castonguay et al. | 335/192 |
| 4,733,321 | | 3/1988 | Lindeperg | 361/96 |
| 4,764,650 | | 8/1988 | Bur et al. | 200/153 G |
| 4,768,007 | | 8/1988 | Mertz et al. | 335/202 |
| 4,780,786 | | 10/1988 | Weynachter et al. | 361/87 |
| 4,831,221 | | 5/1989 | Yu et al. | 200/553 |
| 4,870,531 | | 9/1989 | Danek | 361/93 |
| 4,883,931 | | 11/1989 | Batteux et al. | 200/148 R |
| 4,884,047 | | 11/1989 | Baginski et al. | 335/10 |
| 4,884,164 | | 11/1989 | Dziura et al. | 361/97 |
| 4,900,882 | | 2/1990 | Bernard et al. | 200/147 R |
| 4,910,485 | | 3/1990 | Bolongeat-Mobleu et al. | 335/195 |
| 4,914,541 | | 4/1990 | Tripodi et al. | 361/94 |
| 4,916,420 | | 4/1990 | Bartolo et al. | 335/172 |
| 4,916,421 | * | 4/1990 | Pardini et al. | 335/185 |
| 4,926,282 | | 5/1990 | McGhie | 361/102 |
| 4,935,590 | | 6/1990 | Malkin et al. | 200/148 A |
| 4,937,706 | | 6/1990 | Schueller et al. | 361/396 |
| 4,939,492 | | 7/1990 | Raso et al. | 335/42 |
| 4,943,691 | | 7/1990 | Mertz et al. | 200/151 |
| 4,943,888 | | 7/1990 | Jacob et al. | 361/96 |
| 4,950,855 | | 8/1990 | Bolonegeat-Mobleu et al. | 200/148 A |
| 4,951,019 | | 8/1990 | Gula | 335/166 |
| 4,952,897 | | 8/1990 | Barnel et al. | 335/147 |
| 4,958,135 | | 9/1990 | Baginski et al. | 335/8 |
| 4,965,543 | | 10/1990 | Batteux | 335/174 |
| 4,983,788 | | 1/1991 | Pardini | 200/16 R |
| 5,001,313 | | 3/1991 | Leclerq et al. | 200/148 B |
| 5,004,878 | | 4/1991 | Seymour et al. | 200/144 R |
| 5,029,301 | | 7/1991 | Nebon et al. | 335/16 |
| 5,030,804 | | 7/1991 | Abri | 200/323 |
| 5,057,655 | | 10/1991 | Kersusan et al. | 200/148 B |
| 5,077,627 | | 12/1991 | Fraisse | 361/93 |
| 5,083,081 | | 1/1992 | Barrault et al. | 324/126 |
| 5,095,183 | | 3/1992 | Raphard et al. | 200/148 A |
| 5,103,198 | | 4/1992 | Morel et al. | 335/6 |
| 5,115,371 | | 5/1992 | Tripodi | 361/106 |
| 5,120,921 | | 6/1992 | DiMarco et al. | 200/401 |
| 5,132,865 | | 7/1992 | Mertz et al. | 361/6 |
| 5,138,121 | | 8/1992 | Streich et al. | 200/293 |
| 5,140,115 | | 8/1992 | Morris | 200/308 |
| 5,153,802 | | 10/1992 | Mertz et al. | 361/18 |
| 5,155,315 | | 10/1992 | Malkin et al. | 200/148 R |
| 5,166,483 | | 11/1992 | Kersusan et al. | 200/144 A |
| 5,172,087 | | 12/1992 | Castonguay et al. | 335/160 |
| 5,178,504 | | 1/1993 | Falchi | 411/553 |
| 5,184,717 | | 2/1993 | Chou et al. | 200/401 |
| 5,187,339 | | 2/1993 | Lissandrin | 200/148 F |
| 5,198,956 | | 3/1993 | Dvorak | 361/106 |
| 5,200,724 | | 4/1993 | Gula et al. | 335/166 |
| 5,210,385 | | 5/1993 | Morel et al. | 200/146 R |
| 5,239,150 | | 8/1993 | Bolongeat-Mobleu et al. | 200/148 R |
| 5,260,533 | | 11/1993 | Livesey et al. | 200/401 |
| 5,262,744 | | 11/1993 | Arnold et al. | 335/8 |
| 5,280,144 | | 1/1994 | Bolongeat-Mobleu et al. | 200/148 R |
| 5,281,776 | | 1/1994 | Morel et al. | 218/152 |
| 5,296,660 | | 3/1994 | Morel et al. | 200/146 R |
| 5,296,664 | | 3/1994 | Crookston et al. | 200/401 |
| 5,298,874 | | 3/1994 | Morel et al. | 335/8 |
| 5,300,907 | | 4/1994 | Nereau et al. | 335/172 |
| 5,310,971 | | 5/1994 | Vial et al. | 200/244 |
| 5,313,180 | | 5/1994 | Vial et al. | 335/16 |
| 5,317,471 | | 5/1994 | Izoard et al. | 361/105 |
| 5,331,500 | | 7/1994 | Corcoles et al. | 361/93 |
| 5,334,808 | | 8/1994 | Bur et al. | 200/50 |
| 5,341,191 | | 8/1994 | Crookston et al. | 335/16 |
| 5,347,096 | | 9/1994 | Bolongeat-Mobleu et al. | 200/148 B |
| 5,347,097 | | 9/1994 | Bolongeat-Mobleu et al. | 200/148 B |
| 5,350,892 | | 9/1994 | Rozier | 200/144 B |
| 5,357,066 | | 10/1994 | Morel et al. | 200/17 R |
| 5,357,068 | | 10/1994 | Rozier | 200/148 R |
| 5,357,394 | | 10/1994 | Piney | 361/72 |
| 5,361,052 | | 11/1994 | Ferullo et al. | 335/172 |
| 5,373,130 | | 12/1994 | Barrault et al. | 200/147 R |
| 5,379,013 | | 1/1995 | Coudert | 335/17 |
| 5,424,701 | | 6/1995 | Castonguay et al. | 335/172 |
| 5,438,176 | | 8/1995 | Bonnardel et al. | 200/400 |
| 5,440,088 | | 8/1995 | Coudert et al. | 200/303 |
| 5,449,871 | | 9/1995 | Batteux et al. | 200/401 |
| 5,450,048 | | 9/1995 | Leger et al. | 335/132 |
| 5,451,729 | | 9/1995 | Onderka et al. | 200/18 |
| 5,457,295 | | 10/1995 | Tanibe et al. | 200/293 |
| 5,467,069 | | 11/1995 | Payet-Burin et al. | 335/42 |
| 5,469,121 | | 11/1995 | Payet-Burin | 335/16 |
| 5,475,558 | | 12/1995 | Barjonnet et al. | 361/64 |
| 5,477,016 | | 12/1995 | Baginski et al. | 200/43.11 |
| 5,479,143 | | 12/1995 | Payet-Burin | 335/202 |
| 5,483,212 | | 1/1996 | Lankuttis et al. | 335/132 |
| 5,485,343 | | 1/1996 | Santos et al. | 361/115 |
| 5,493,083 | | 2/1996 | Olivier | 200/17 R |
| 5,504,284 | | 4/1996 | Lazareth et al. | 200/50 R |
| 5,504,290 | | 4/1996 | Baginski et al. | 200/401 |
| 5,510,761 | | 4/1996 | Boder et al. | 335/172 |
| 5,512,720 | | 4/1996 | Coudert et al. | 200/400 |
| 5,515,018 | | 5/1996 | DiMarco et al. | 335/16 |
| 5,519,561 | | 5/1996 | Mrenna | 361/105 |
| 5,534,674 | | 7/1996 | Steffens | 218/154 |
| 5,534,832 | | 7/1996 | Duchemin et al. | 335/16 |
| 5,534,835 | | 7/1996 | McColloch et al. | 335/172 |
| 5,534,840 | | 7/1996 | Cuingnet | 337/1 |
| 5,539,168 | | 7/1996 | Linzenich | 200/303 |
| 5,543,595 | | 8/1996 | Mader et al. | 200/401 |
| 5,552,755 | | 9/1996 | Fello et al. | 335/18 |
| 5,581,219 | | 12/1996 | Nozawa et al. | 335/132 |

| | | | |
|---|---|---|---|
| 5,604,656 | 2/1997 | Derrick et al. | 361/187 |
| 5,608,367 | 3/1997 | Zoller et al. | 335/132 |
| 5,784,233 | 7/1998 | Bastard et al. | 361/36 |

FOREIGN PATENT DOCUMENTS

| | | | |
|---|---|---|---|
| 38 02 184 | 8/1989 | (DE) | H01H/3/46 |
| 38 43 277 | 6/1990 | (DE) | H02H/3/08 |
| 44 19 240 | 1/1995 | (DE) | H01H/9/10 |
| 0 061 092 | 9/1982 | (EP) | G03G/5/14 |
| 0 064 906 | 11/1982 | (EP) | H01H/71/74 |
| 0 066 486 | 12/1982 | (EP) | H01H/71/52 |
| 0 076 719 | 4/1983 | (EP) | H01H/71/74 |
| 0 117 094 | 8/1984 | (EP) | H01H/71/10 |
| 0 140 761 | 5/1985 | (EP) | H01H/71/52 |
| 0 174 904 | 3/1986 | (EP) | H01H/1/20 |
| 0 196 241 | 10/1986 | (EP) | H01H/71/00 |
| 0 224 396 | 6/1987 | (EP) | H01H/71/52 |
| 0 235 479 | 9/1987 | (EP) | H02H/3/04 |
| 0 239 460 | 9/1987 | (EP) | H01H/33/24 |
| 0 258 090 | 3/1988 | (EP) | H02H/7/22 |
| 0 264 313 | 4/1988 | (EP) | H01H/83/04 |
| 0 264 314 | 4/1988 | (EP) | H01H/83/00 |
| 0 283 189 | 9/1988 | (EP) | H02B/13/02 |
| 0 283 358 | 9/1988 | (EP) | H02H/3/10 |
| 0 291 374 | 11/1988 | (EP) | H01H/83/20 |
| 0 295 155 | 12/1988 | (EP) | H01H/83/20 |
| 0 295 158 | 12/1988 | (EP) | H01H/71/52 |
| 0 313 106 | 4/1989 | (EP) | H02B/13/02 |
| 0 313 422 | 4/1989 | (EP) | H02H/1/00 |
| 0 314 540 | 5/1989 | (EP) | H01H/1/20 |
| 0 331 586 | 9/1989 | (EP) | H01H/83/20 |
| 0 337 900 | 10/1989 | (EP) | H01H/71/32 |
| 0 342 133 | 11/1989 | (EP) | H01H/71/50 |
| 0 367 690 | 5/1990 | (EP) | H02H/3/04 |
| 0 371 887 | 6/1990 | (EP) | H01H/71/10 |
| 0 375 568 | 6/1990 | (EP) | H01H/71/02 |
| 0 394 144 | 10/1990 | (EP) | H01H/71/46 |
| 0 394 922 | 10/1990 | (EP) | H01H/1/20 |
| 0 399 282 | 11/1990 | (EP) | H01H/73/04 |
| 0 407 310 | 1/1991 | (EP) | H02H/3/347 |
| 0 452 230 | 10/1991 | (EP) | H01H/71/50 |
| 0 555 158 | 8/1993 | (EP) | H01H/71/52 |
| 0 560 697 | 9/1993 | (EP) | H01H/77/10 |
| 0 567 416 | 10/1993 | (EP) | H01H/9/26 |
| 0 595 730 | 5/1994 | (EP) | H01H/71/08 |
| 0 619 591 | 10/1994 | (EP) | H01H/71/40 |
| 0309923 | 12/1994 | (EP) . | |
| 0 665 569 | 8/1995 | (EP) | H01H/83/22 |
| 0 700 140 | 3/1996 | (EP) | H02H/3/33 |
| 0 889 498 | 1/1999 | (EP) | H01H/73/04 |
| 2 410 353 | 6/1979 | (FR) | H01H/51/24 |
| 2 512 582 | 3/1983 | (FR) | H01H/9/20 |
| 2 553 943 | 4/1985 | (FR) | H02N/3/33 |
| 2 592 998 | 7/1987 | (FR) | H02H/3/10 |
| 2 682 531 | 4/1993 | (FR) | H01H/71/10 |
| 2 697 670 | 5/1994 | (FR) | H01H/51/27 |
| 2 699 324 | 6/1994 | (FR) | H01H/71/10 |
| 2 714 771 | 7/1995 | (FR) | H02H/7/045 |
| 2 233 155 | 1/1991 | (GB) | H01H/77/10 |
| 1 227 978 | 4/1986 | (SU) | G01N/3/30 |
| 92/00598 | 1/1992 | (WO) | H01H/1/50 |
| 92/05649 | 4/1992 | (WO) | H04M/1/00 |
| 94/00901 | 1/1994 | (WO) | H02H/5/04 |

* cited by examiner

ROTARY CONTACT ASSEMBLY FOR HIGH AMPERE-RATED CIRCUIT BREAKERS

CROSS REFERENCE OF RELATED APPLICATIONS

This is a continuation-in-part of application Ser. No. 09/087038, filed May 29, 1998.

BACKGROUND OF THE INVENTION

U.S. Pat. No. 4,616,198 entitled "Contact Arrangement for a Current Limiting Circuit Breaker" describes the early use of a first and second pair of circuit breaker contacts arranged in series to substantially reduce the amount of current let through upon the occurrence of an overcurrent condition.

When the contact pairs are arranged upon one movable contact arm such as described within U.S. Pat. No. 4,910,485 entitled "Multiple Circuit Breaker with Double Break Rotary Contact", some means must be provided to insure that the opposing contact pairs exhibit the same contact pressure to reduce contact wear and erosion.

One arrangement for providing uniform contact wear is described within U.S. Pat. No. 4,649,247 entitled "Contact Assembly for Low-voltage Circuit Breakers with a Two-Arm Contact Lever". This arrangement includes an elongate slot formed perpendicular to the contact travel to provide uniform contact closure force on both pairs of contacts.

U.S. Pat. No. 5,030,804 entitled "Contact Arrangement for Electrical Switching Devices" describes providing a pair of cylindrical plates on either side of the contact arms and forming elongated slots within each of the cylindrical plates.

Other examples of circuit breakers employing rotary contacts are found in U.S. Pat. No. 5, 281,776 entitled "Multipole Circuit Breaker with Single Pole Units; U.S. Pat. No. 5,310,971 entitled "Molded Case Circuit Breaker with Contact Bridge Slowed Down at the End of Repulsion Travel"; and U.S. Pat. No. 5,357,066 entitled "Operating Mechanism for a Four-Pole Circuit Breaker".

State of the art circuit breakers employing a rotary contact arrangement employ a rotor assembly and pair of powerful expansion springs to maintain contact between the rotor assembly and the rotary contact arm as well as to maintain good electrical connection between the contacts, per se. The added compression forces provided by the powerful expansion springs must be overcome when the contacts become separated by the contact "blow open" forces of magnetic repulsion that occur upon extreme overcurrent conditions within the protected circuit before the circuit breaker operating mechanism has time to respond.

Accordingly, it is believed advantageous to have a rotary contact arrangement with expansion springs arranged between the rotary assembly and the rotary contact arm that maintain good electrical connection between the contacts during quiescent operating current conditions while enhancing contact separation upon occurrence of extreme overcurrent conditions.

SUMMARY OF THE INVENTION

A circuit breaker rotary contact assembly employs a common pivot between the rotor assembly and a two piece rotary contact arm assembly. A pair of off-center expansion springs directly engages the rotor at one end and engages the rotary contact arm assembly via a linkage arrangement at an opposite end thereof. The rotary contact arm assembly is slotted at a central portion for tolerance compensation between the rotary contact assembly components as well as to reduce contact wear and contact erosion.

DESCRIPTION OF THE PREFERRED EMBODIMENT

Figure 1:
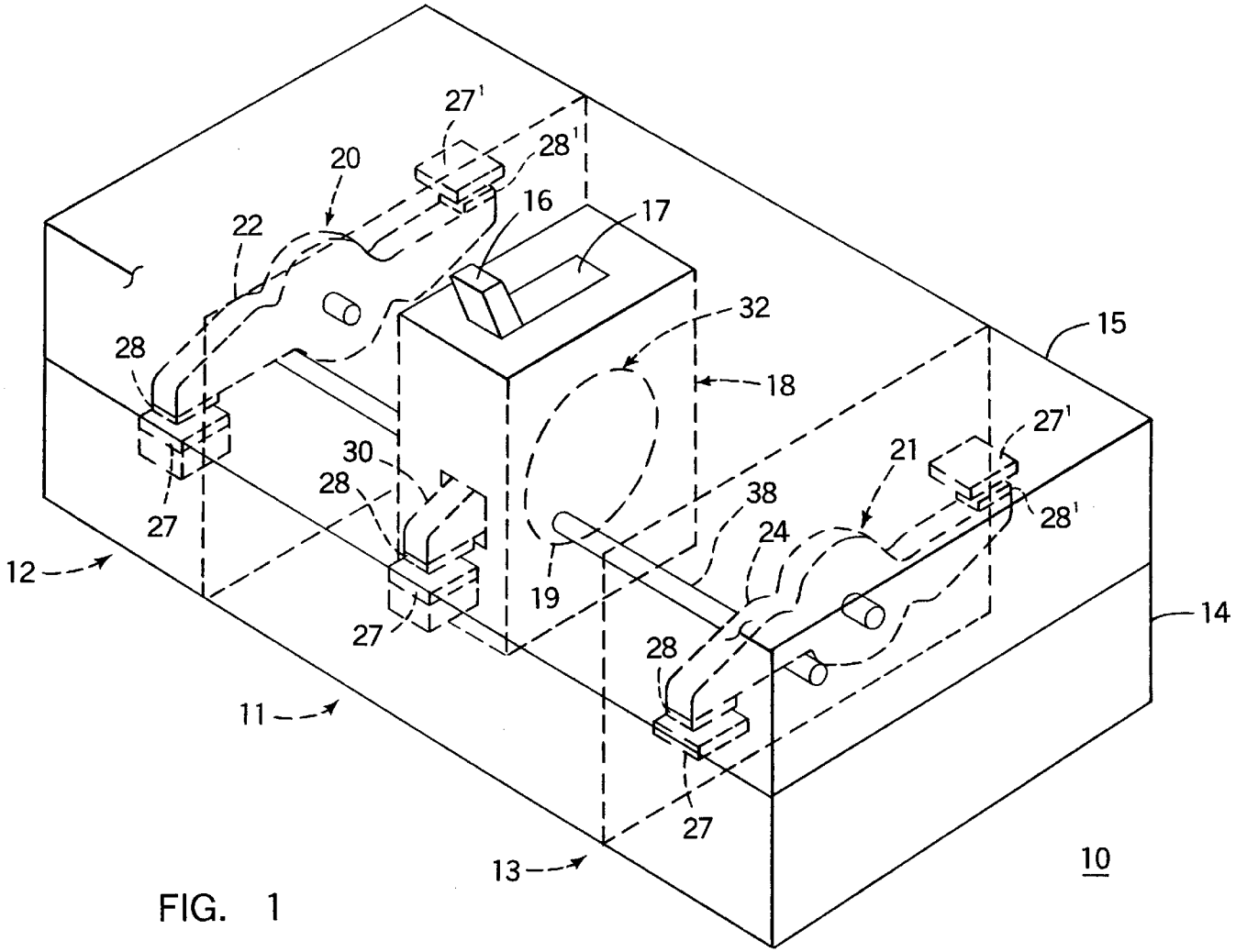
FIG. 1 is a top perspective view of a circuit breaker employing a rotary contact assembly according to the invention.

A multi-pole circuit breaker 10 is shown in FIG. 1 consisting of a case 14 and cover 15 with an operating handle 16 projecting from the cover through an aperture 17. The operating handle interacts with the circuit breaker operating mechanism 18 to control the ON and OFF positions of the central rotary contact arm 30, and central rotary contact arm assembly 32 within the circuit breaker operating mechanism. The contact arm assembly 32 being formed within the central pole 11. A first rotary contact arm 22 and first rotary contact arm assembly 20 within a first pole 12, on one side of the operating mechanism 18 within the central pole 11, and a second rotary contact arm 24 and second rotary contact arm assembly 21 within a second pole 13 on the opposite side of the central pole, move in unison to provide complete multi-pole circuit interruption. An elongated pin 38 interconnects the operating mechanism 18 with the center, first and second rotary contact arm assemblies 32, 20, 21. As described within the aforementioned U.S. Pat. No. 4,649,247 a rotor 19 interconnects each of the rotary contact arms 22, 24, 30 with the corresponding pairs affixed contacts 27, 27' and, movable contacts 28, 28'.

Figure 2:
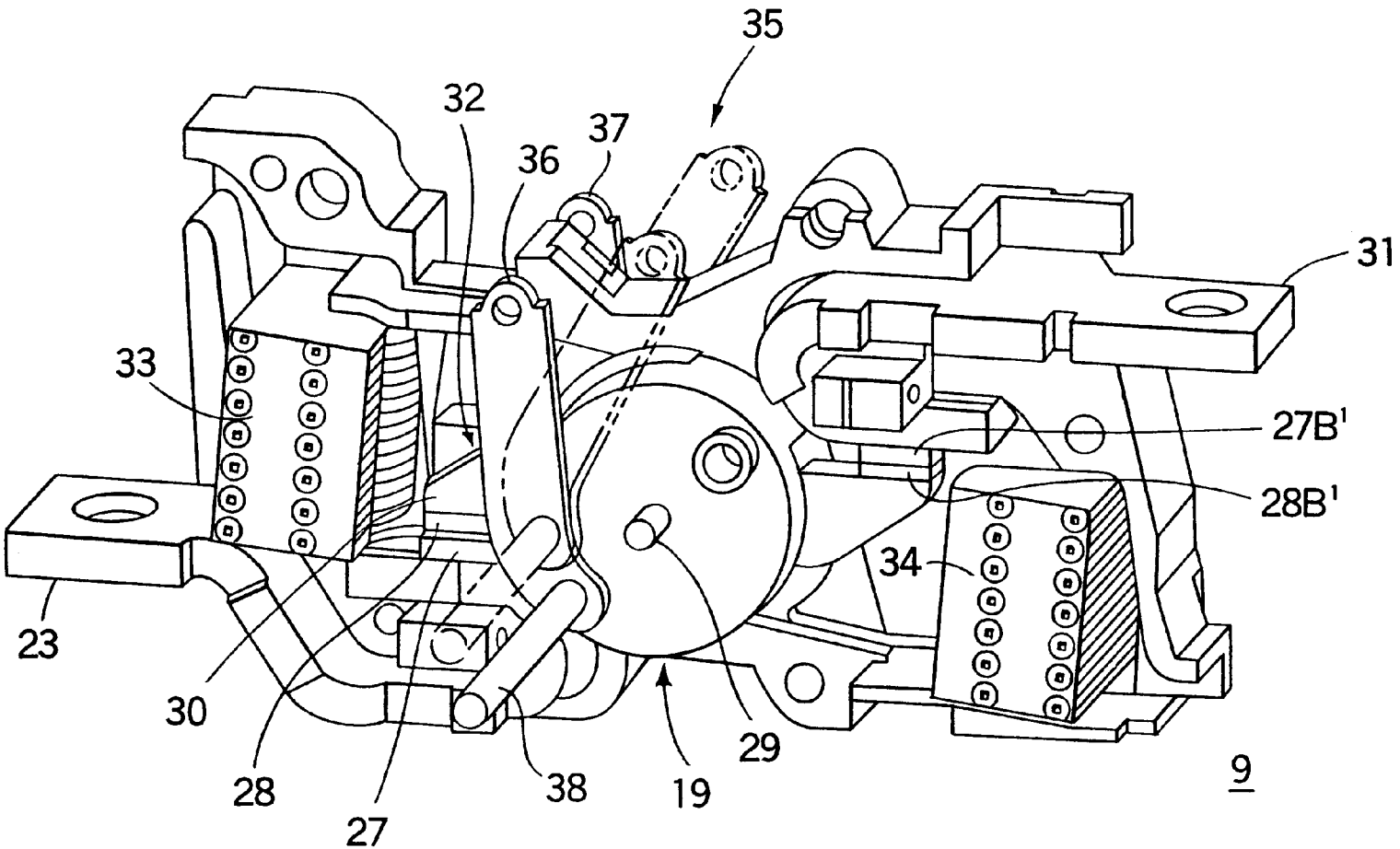
FIG. 2 is a top perspective view of the complete contact assembly contained within the circuit breaker of FIG. 1.

The rotor 19 in the circuit breaker assembly 9 is depicted FIG. 2 intermediate the line strap 23 and load strap 31 and the associated arc chutes 33, 34. The first rotary contact arm assembly 20 and second rotary contact arm assembly 21 of FIG. 1 are not shown herein but are mirror images of the central rotary contact arm assembly 32 and operate in a similar manner. The arc chutes 33, 34 are similar to that described within U.S. Pat. No. 4,375,021 entitled "Rapid Electric Arc Extinguishing Assembly in Circuit Breaking Devices Such as Electric Circuit Breakers". The central rotary contact arm 30 moves in unison with the rotor 19 that, in turn, connects with the circuit breaker operating mechanism 18 of FIG. 1 by means of the elongated pin 38 to move the movable contacts 28, 28' between the CLOSED position depicted in solid lines in FIG. 4 and the OPEN position. The clevis 35 consisting of the extending sidearms 36, 37 attach the rotor 19 with the circuit breaker operating mechanism 18 and the operating handle 16 of FIG. 1 to allow both automatic as well as manual intervention for opening and closing the circuit breaker contacts 27, 27' and 28, 28'. The rotor 19 is positioned between the line and load straps 23, 31 along with one of the contact pairs 27, 28, 27', 28' to hold the contacts in close abutment to promote electrical transfer between the fixed and moveable contacts during quiescent circuit current conditions. The operating pivot pin 29 of the central rotary contact arm 30 extends through the rotor 19 and responds to the rotational movement of the rotor to effect the contact closing and opening function in the manner described within the U.S. patent application Ser. No. 09/108684, filed Jul. 1, 1998 entitled "Rotary Contact Assembly for High Ampere-Rated Circuit Breakers" which is incorporated herein by reference.

Figure 3:
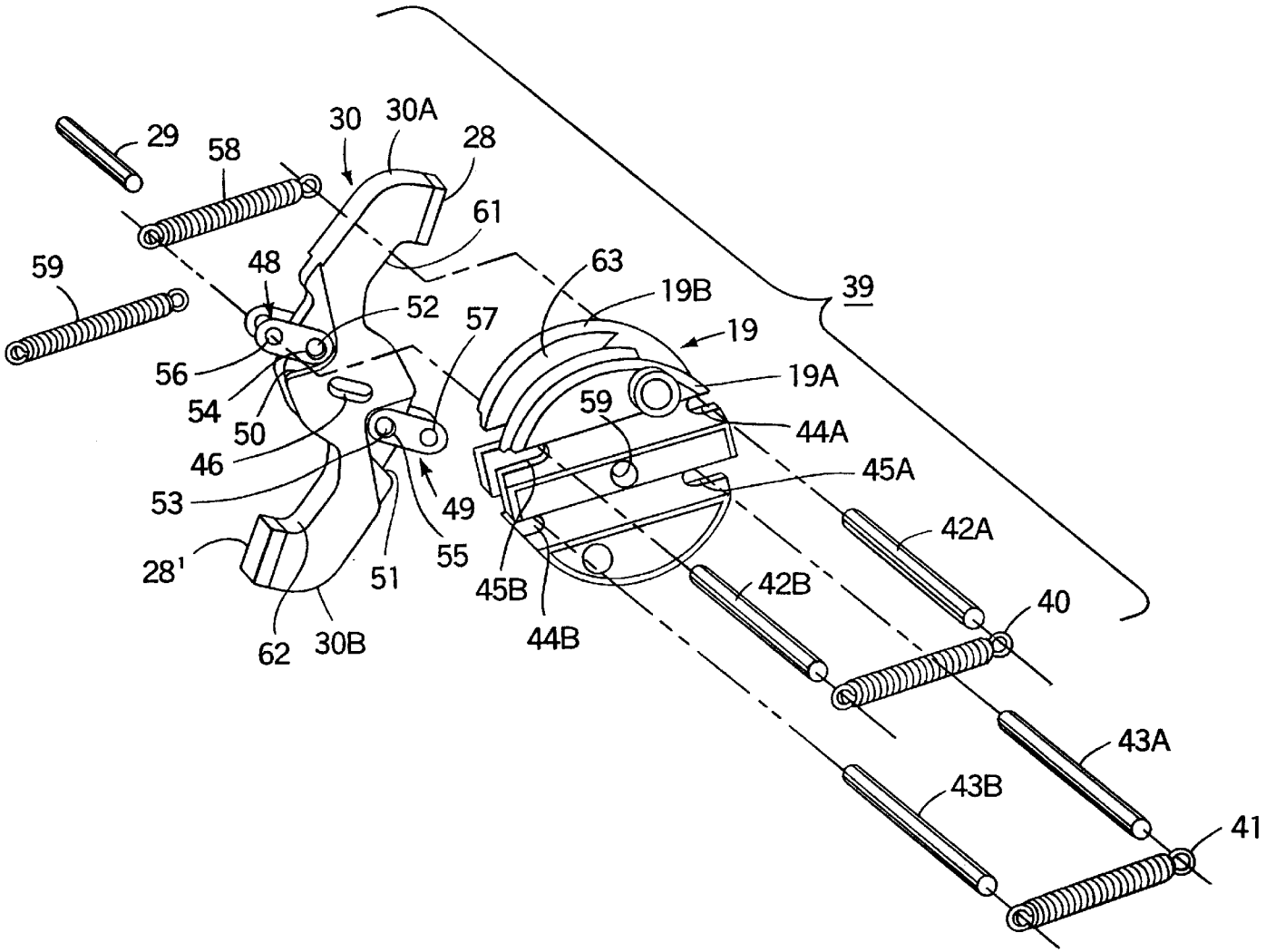
FIG. 3 is an enlarged top perspective view of the rotor in isometric projection with the contact arm assembly of FIG. 2.

In accordance with the teachings of the invention, a hinged attachment between the slotted rotor surfaces 19A, 19B arranged on opposite sides of the slotted movable contact arm 30 within the rotor assembly 39 as now shown in FIG. 3 provides for automatic tolerance compensation between the slotted rotors and the slotted movable contact arms within all three poles 11–13 of the circuit breaker 10 of FIG. 1. The slotted contact arm 30 includes a slotted pivot aperture 46 for receiving the pivot pin 29 and a pair of top and bottom links 48, 49 attached to the slotted movable contact arm by means of pins 52, 53 and apertures 54, 55 arranged within the V-shaped slots 50, 51. The slotted rotor 19 defines a pair of outer surfaces 19A, 19B each include central apertures, one of which is shown at 60 for receiving the pivot pin 29, along with opposing shallow slots 44A, 44B and opposing deep slots 45A, 45B, as indicated. A first expansion spring 40 is attached to the slotted rotors by means of first pins 42A, 42B. The slotted contact arm 30 is inserted within the slot 63 formed within the slotted rotor intermediate the rotor outer surfaces 19A, 19B. The first pin 42A extends through the shallow slot 44A and the second pin 42B extends through the deep slot 45B. The first pin 42A extends under the surface 61 defined under the movable contact arm 30A and then through one end of an opposing expansion spring 58 on the rotor outer surface 19B. The second pin 42B extends through the deep slot 45B, through the aperture 56 in the top link 48, and then through the other end of the expansion spring 58 on the rotor outer surface 19B. A second expansion spring 41 is attached to the slotted rotor by means of second pins 43A, 43B. The second pin 43A extends through the deep slot 45A, through the aperture 57 in the bottom link 49, and then through one end of an opposing expansion spring 59 on the rotor outer surface 19B. The second pin 43B extends through the shallow slot 44B, over the surface 62 defined on the movable contact arm 30B and then through the other end of the expansion spring 59 on the rotor outer surface 19B.

Figure 4:
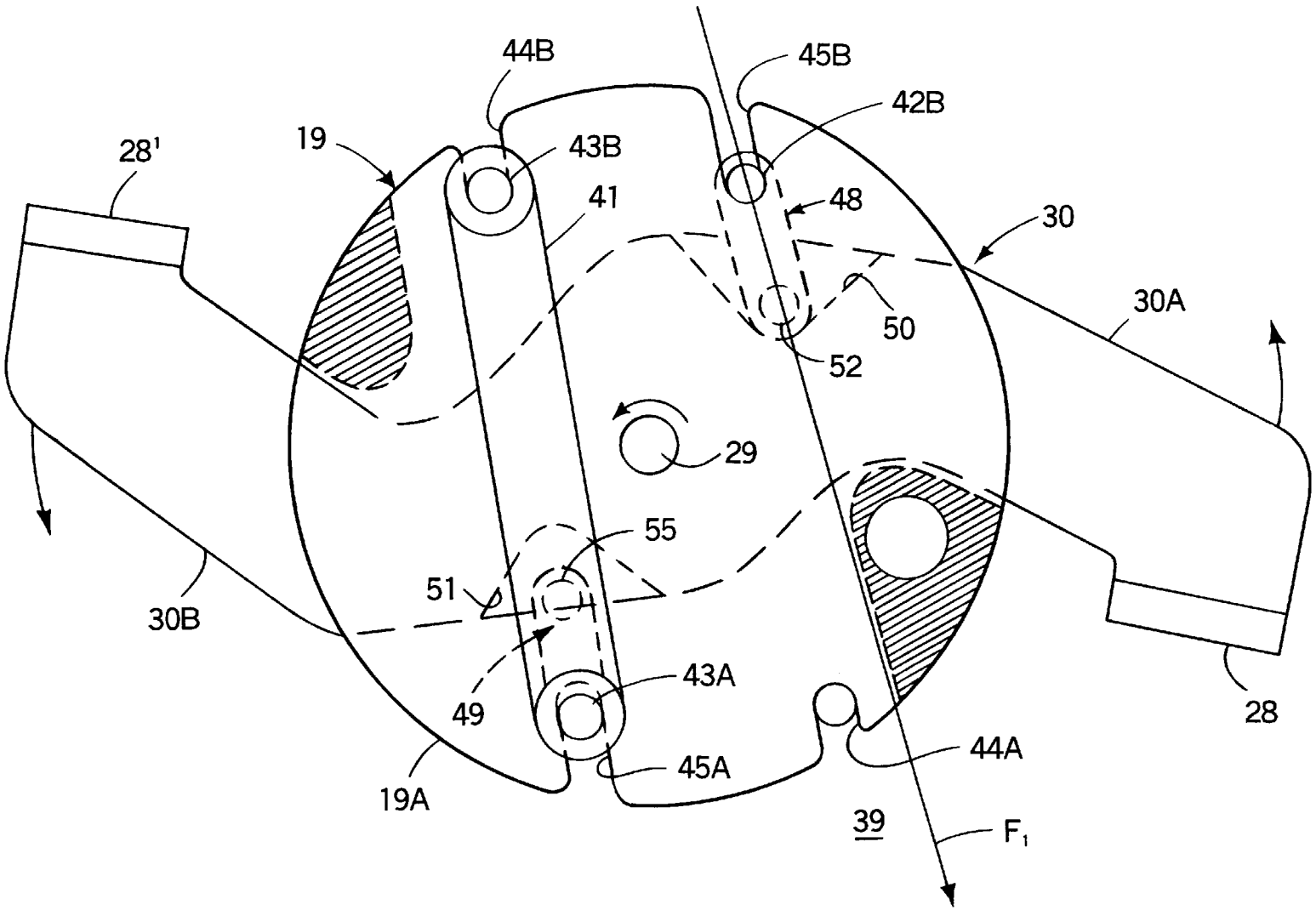
FIG. 4 is an enlarged front plan view of the rotary contact arm assembly according to the invention with the contacts in the CLOSED position.

The slotted rotor assembly 39 is depicted in FIG. 4 with the movable contacts 28, 28' on the opposite ends of the contact arms 30A, 30B in the CLOSED condition relative to the fixed contacts 27, 27' (shown in FIG. 1). The top and bottom links 48, 49 are arranged on the top and bottom parts of the slotted contact arm 30 within the V-shaped slots 50, 51 and within the associated slots 45A, 45B on the slotted rotor 19 as viewed from the rotor surface 19A. The expansion spring 41 is shown arranged between the pins 43A, 43B and the expansion spring 40 between the pin 42B in the top link 48 and the pin 42A is omitted to show the positional relationship between the line of force $F_1$, directed through the pins 42B, 52 in the top link 48. This arrangement provides optimum contact pressure between the movable and fixed contacts 28, 27, 28', 27' while allowing for contact wear compensation and tolerance adjustment between the components within the rotor assemblies 39 within the individual poles within the circuit breaker of FIG. 1.

Figure 5:
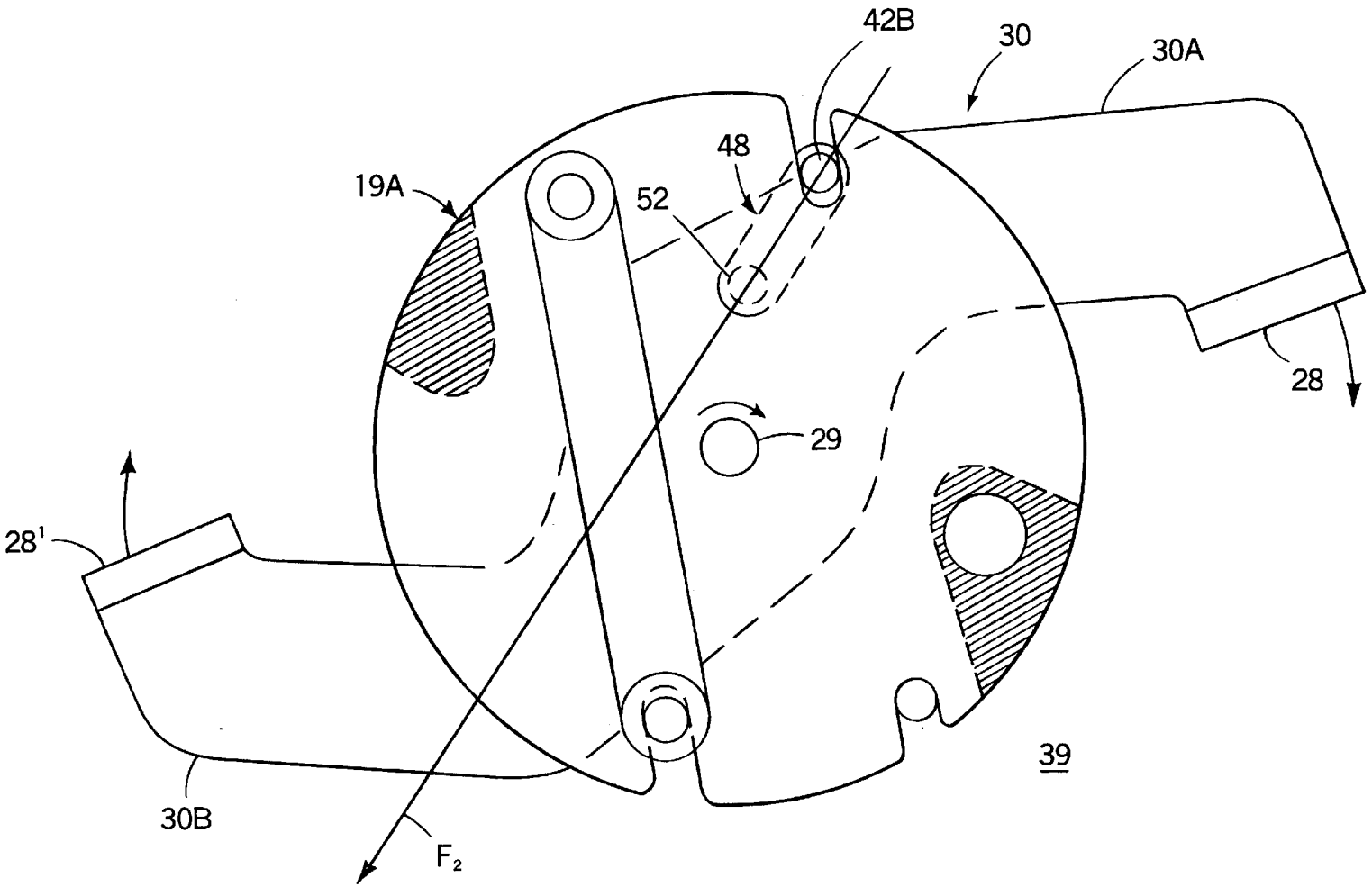
FIG. 5 is an enlarged front plan view of the rotary contact arm assembly according to the invention with the contacts in the OPEN position.

Upon occurrence of a large overcurrent condition within the circuit breaker assembly of FIG. 2 containing the slotted rotor assembly 39 of FIG. 5, the magnetic repulsion forces generated between the movable and fixed contacts 28, 27,27' (shown in FIG. 1) within the circuit breaker assembly drive the movable contact arms 30A, 30B and the associated movable contacts 28, 28' in the counterclockwise direction about the pivot pin 29 to the OPEN position shown in FIG. 5. The rotation of the upper link 48 moves the link pin 52 to the position indicated in FIG. 5 such that the line of force exerted by the expansion springs 40, 41 (FIG. 3) is now directed through the pins 42B, 52 in the top link 48 as indicated at $F_2$, locking the slotted contact arm 30 in the OPEN position to prevent re-closure of associated the movable and fixed contacts 28, 27, 28', 27' until the circuit breaker operating mechanism 18 shown in FIG. 1 has responded to separate the movable and fixed contacts 28, 27, 28', 27' within each of the circuit breaker poles 11–13. Upon movement of the circuit breaker operating handle 16 to reset the circuit breaker operating mechanism, the slotted contact arm 30 rotates in the clockwise direction about the pivot 29 to return the contact arms 30A, 30B to the CLOSED position shown in FIG. 4. It has been determined that the automatic expansion and contraction of the springs 40, 41,58, 59, the top and bottom links 48, 49 and the provision of the slots 44A, 44B, 45A, 45B of FIG. 3 results in the best tolerance adjustment between the rotor assembly 39 than has ever heretofore been attainable in so-called rotary contact arrangements with self locking contact arm capabilities within circuit breakers.

U.S. Pat. No. 4,616,198 entitled "Contact Arrangement for a Current Limiting Circuit Breaker" describes a circuit interruption arrangement having a single pair of fixed and movable contacts that become separated by rotation of a single contact arm to which the movable contact is attached at one end.

Figure 6:
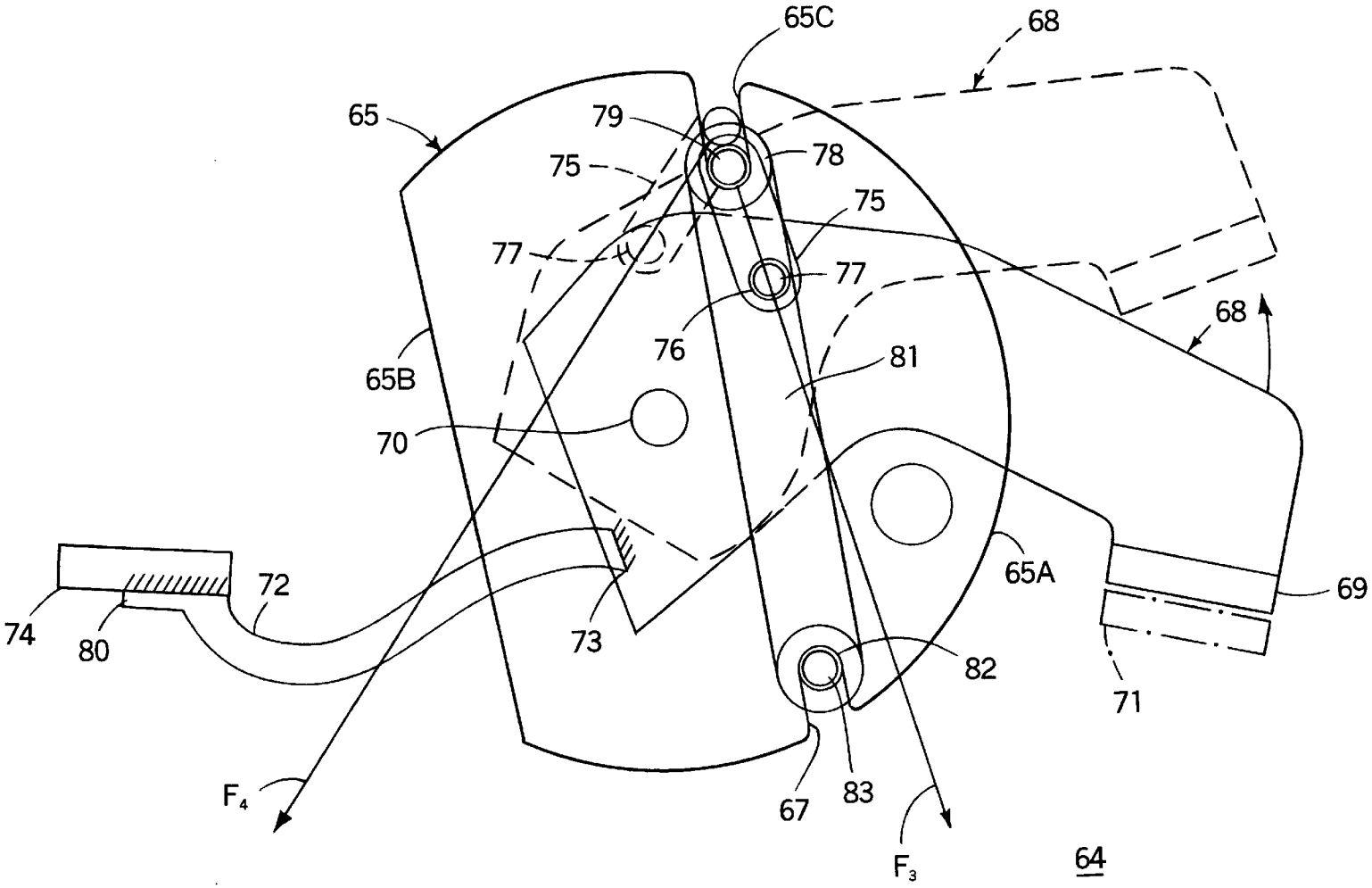
FIG. 6 is an alternate embodiment of the rotary contact arm assembly according to the invention.

In further accordance with the teachings of the invention, a semi-rotor assembly 64 is depicted in FIG. 6 to include a semi-rotor 65 having a circular forward surface as indicated at 65A and a planar rear surface as indicated at 65B. The movable contact 69 is positioned at one end of the contact arm and the pivot pin 70 attaches the contact arm to the semi-rotor 65 at the opposite end thereof. A contact braid 72 is fixedly attached to the movable contact arm as indicated at 73 at one end, and to the load strap 74 at the opposite end as indicated at 80. In a similar manner as described with respect to FIGS. 3–5, a link 75 connects with the contact arm 68 at one end by means of the pin 77 and is positioned within the slot 65C within the semi-rotor 65 and is retained therein by means of the extended pin 79. A similar expansion spring 81 extends between the pin 79 at one end of the expansion spring as indicated at 78 and the extended pin 82 within the slot 67 at the opposite end of the expansion spring as indicated at 83. An opposing expansion spring (not shown) extends between the pin 79 and the extended spring pin 82 on the other side of the semi-rotor assembly 64. The link 75 is arranged such that the force line $F_3$ exhibited by the expansion spring between the semi-rotor and the contact arm is directed along the link pins 77, 79 resulting in the maximum contact pressure exhibited between the movable and fixed contacts 69, 71 when the contacts are in the CLOSED position indicated in solid lines. Upon occurrence of a large overcurrent condition within the circuit breaker assembly of FIG. 2 containing the semi-rotor assembly 64 of FIG. 6, the magnetic repulsion forces generated between the movable and fixed contacts 69, 71 within the circuit breaker assembly drive the movable contact arm 68 and the associated movable contact 69 in the counterclockwise direction about the pivot pin 70 to the OPEN position indicated in dashed lines. The force line $F_4$ exhibited by the expansion spring between the semi-rotor and the contact arm is now directed along the link pins 77, 79 in such a manner that the movable contact arm 68 is locked in the OPEN position to prevent re-closure of associated the movable and fixed contacts 69, 71 until the circuit breaker operating mechanism 18 shown in FIG. 1 has responded to separate the movable and fixed contacts 28, 27 within each of the circuit breaker poles 11–13. Upon movement of the circuit breaker operating handle 16 to reset the circuit breaker operating mechanism, the movable contact arm 68 rotates in the clockwise indicate direction about the pivot 70 to return the contact 69 to the CLOSED position in the manner described earlier.

The provision of a link connection between a rotor assembly and a movable contact arm has been shown herein to improve performance of a circuit breaker during contact separation as well as contact closure. The arrangement of at least one expansion spring between the link and the associated rotor provides optimum contact force by compensating for component tolerance and contact erosion and wear while still maintaining a reliable means for locking the contact arm 30 open in the event of an over current condition.

Figure 7:
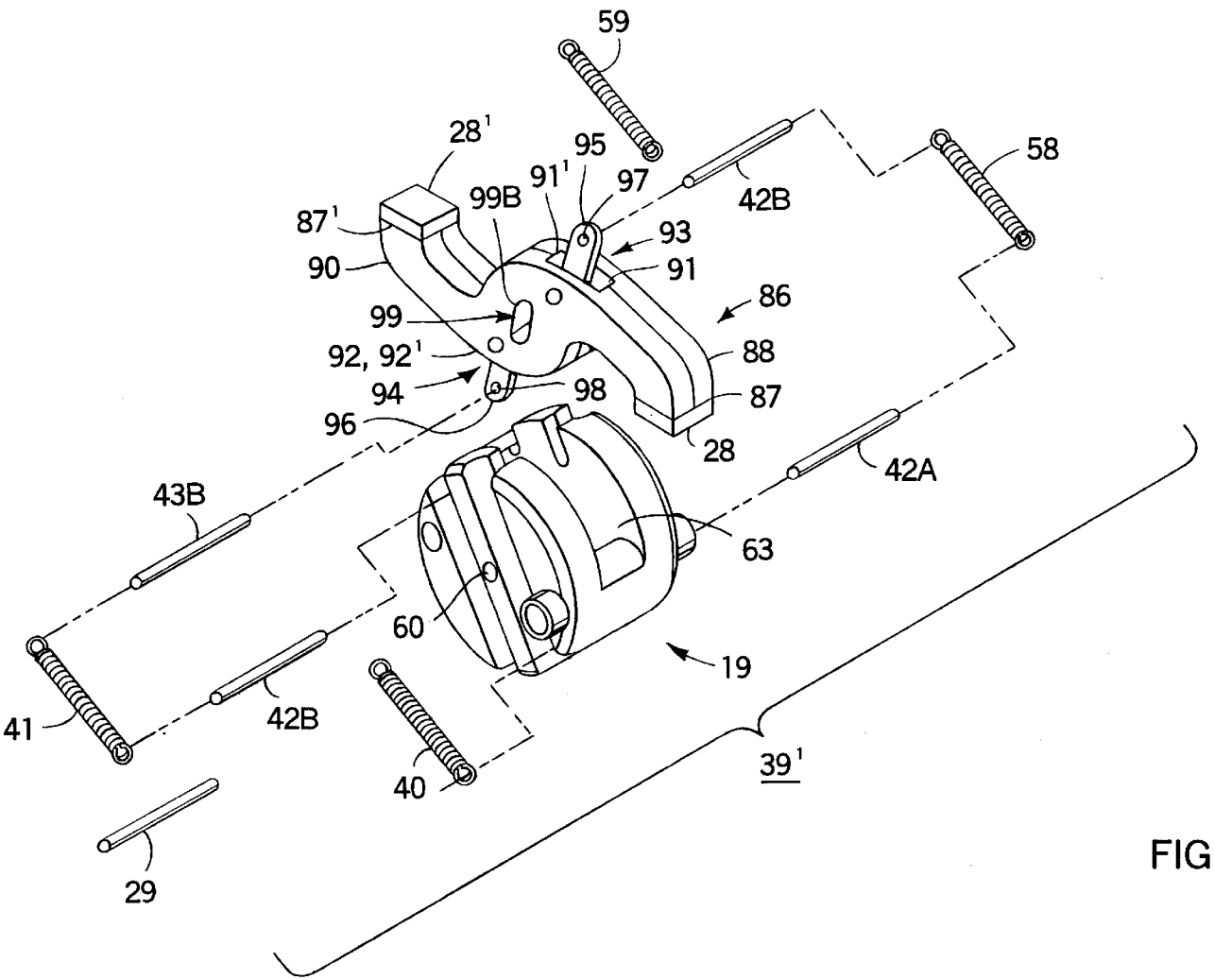
FIG. 7 is a perspective view of the rotor assembly with a two piece contact arm assembly.

An another alternate embodiment is the rotor assembly 39' shown in FIG. 7. In this embodiment, the contact arm 30 of assembly 39 is replaced by a two piece contact arm assembly 86. The contact arm assembly 86 is made from two contact arm halves 88, 90. These contact arm halves 88, 90 are held together by the braze joint 87,87' that also secures the movable contacts 28, 28' to the contact arm assembly 86. Each contact arm half 88, 90 has a slot 91, 91', 92, 92' which when assembled defines the slots 93, 94 which are sized to receive a single linkage 95, 96. The single linkage 95, 96 takes the place of and performs the same function as the pair of linkages 48, 49 in rotor assembly 39. By replacing the pair of linkages 48, 49 with the single linkage 95, 96, less parts are required, reducing manufacturing costs and making it easier to assemble than is possible with the rotor assembly 39. Additionally, by eliminating the thickness of one of one linkage in the contact arm/linkage assembly, more material can be added to the rotor and thus increase the manufacturability of the rotor 19.

The contact arm assembly 86 is inserted into slot 63 and is held in the rotor by pins 42B, 43B which are inserted into the apertures 97, 98 in the linkages 95,96 and the expansion springs 40, 41, 58, 59. The pin 29 is inserted into the central opening 60 in the rotor 19 and through the slot 99 in the contact arm assembly 86 in a similar manner to that described above for rotor assembly 39. The function and operation of the rotor assembly 39' is identical to that described above for rotor assembly 39.

Figure 8:
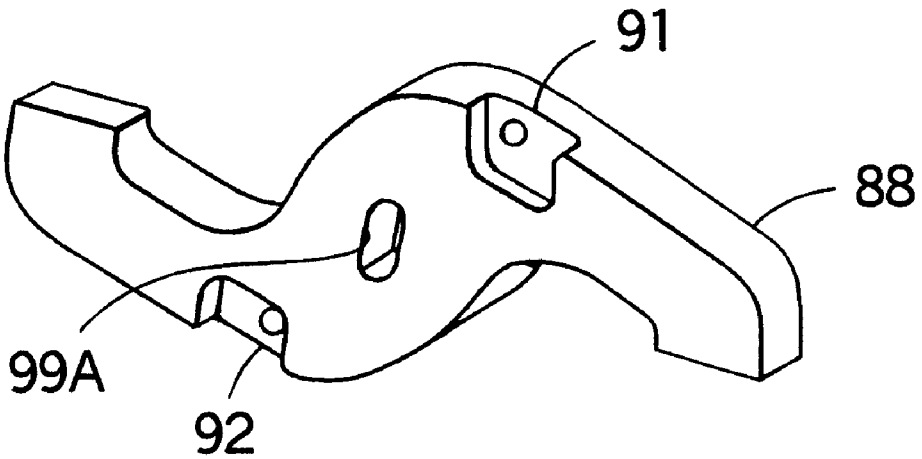
FIG. 8 s a perspective view of one of the contact arms shown in FIG. 7.

The contact arm half 88 is shown in FIG. 8. The slots 91, 92 may be formed in the contact arm half 88 by any method conducive to effective manufacturing, such as machining or coining. The slot 99A along with the respective slot 99B in the adjoining contact arm half 90 for the slot 99 in the contact arm assembly 86. Note, the contact arm half 90 is a mirror image of the contact arm half 88.

What is claimed is:

1. A circuit breaker comprising:

a base;

a cover attached to said base;

an operating mechanism arranged within said base;

a first rotor assembly within said case and interconnecting with said operating mechanism, said rotor assembly comprising:

a circular rotor having a rotor aperture through a central portion thereof;

a first moveable contact arm having a contact aperture through a central portion thereof;

a second moveable contact arm having a contact aperture through a central portion thereof, said second moveable contact arm being adjoined to said first moveable contact arm such that said first moveable contact aperture is coaxial with said second moveable contact arm aperture;

a pivot pin extending through said rotor aperture and said first contact arm contact aperture for allowing rotation of said first contact arm with respect to said rotor; and a first linkage having a first and second end, said linkage being pivotally attached to said first contact arm at said first end and connected to said rotor at an second end.

2. The circuit breaker of claim 1 including a first moveable contact attached to an end of said first contact arm.

3. The circuit breaker of claim 2 wherein said moveable contact is also attached to said second contact arm.

4. The circuit breaker of claim 3 wherein said first contact arm has a first slot adjacent to said first contact arm contact aperture and lying in the plane of rotation of said first contact arm, said first linkage attached to said first contact arm and positioned within said first slot.

5. The circuit breaker of claim 4 wherein said first contact arm has a second slot adjacent to said first contact arm contact aperture and opposite said first slot.

6. The circuit breaker of claim 5 further comprising:

a second linkage having a first and second end, said second linkage being pivotally attached to said first contact arm at said first end and positioned within said second slot and connected to said rotor at said second end.

7. The circuit breaker of claim 6 further including a first spring on a one side of said rotor and a first pair of pins attaching said first contact arm to said rotor on said one side.

8. The circuit breaker of claim 7 further including a second spring on a opposite side of said rotor, said first pair of pins attaching said first contact arm to said rotor on said opposite side.

9. The circuit breaker of claim 8 wherein one of said first pair of pins further extends through said first linkage.

10. The circuit breaker of claim 9 including a third spring on said one side of said rotor and a second pair of pins attaching said first contact arm to said rotor on said one side.

11. The circuit breaker of claim 10 including fourth spring on said opposite side of said rotor, said second pair of pins attaching said first contact arm to said rotor on said opposite side.

12. The circuit breaker of claim 11 wherein one of said second pair of pins further extends through said second linkage.

13. The circuit breaker of claim 12 wherein said first pair of pins are disposed in a first pair of opposing slots in said rotor.

14. The circuit breaker of claim 13 wherein said second pair of pins are disposed in a second pair of opposing slots in said rotor.

15. The circuit breaker of claim 14 further comprising:

a second movable contact attached to said first contact arm at an end opposite said first movable contact.

16. The circuit breaker of claim 15 further comprising:

a second rotor assembly adjoined to said first rotor assembly on a first side of said rotor assembly.

17. The circuit breaker of claim 16 further comprising:

a third rotor assembly adjoined to said first rotor assembly on a side opposite said second rotor assembly.

18. The circuit breaker of claim 15 further comprising:

first and second straps, said first and second straps each having a stationary contact attached thereto, said first and second straps being arranged within said base such that the first strap stationary contact has an electrical connection to said first moveable contact and said second stationary contact has an electrical connection to said second movable contact.

19. The circuit breaker of claim 18 wherein said operating mechanism is movable between an on and off position, said rotor assembly being arranged to move said first and second movable contacts in and out of electrical contact with the corresponding first and second stationary contact.

* * * * *